US005855400A

United States Patent [19]

Ohhashi et al.

[11] Patent Number: 5,855,400

[45] **Date of Patent: *Jan. 5, 1999**

[54] DOOR LOCK ASSEMBLY FOR AUTOMOTIVE VEHICLES

[75] Inventors: Masao Ohhashi, Kariya; Nozomu Torii, Hekinan; Shigeru Hayakawa, Chiryu, all of Japan

[73] Assignee: Aisin Seiki Kabushiki Kaisha, Kariya, Japan

[ * ] Notice: The term of this patent shall not extend beyond the expiration date of Pat. No. 5,582,444.

[21] Appl. No.: 710,538

[22] Filed: Sep. 19, 1996

Related U.S. Application Data

[63] Continuation of Ser. No. 313,576, Sep. 27, 1994, abandoned.

[30] Foreign Application Priority Data

Sep. 29, 1993 [JP] Japan ..... 5-243050

[51] Int. Cl.[6] ..... E05B 3/00

[52] U.S. Cl. ..... 292/336.3; 292/DIG. 23

[58] Field of Search ..... 292/336.3, 337, 292/216, 346, DIG. 23; 70/416, 418

[56] References Cited

U.S. PATENT DOCUMENTS

| | | | |
|---|---|---|---|
| 3,415,559 | 12/1968 | Jeavons | 292/216 |
| 4,575,138 | 3/1986 | Nakamura | 292/216 |
| 4,586,737 | 5/1986 | Arlauskas | 292/216 |
| 4,850,625 | 7/1989 | Hori | 292/336.3 |
| 4,869,536 | 9/1989 | Kleefeldt | 292/DIG. 73 |
| 4,904,006 | 2/1990 | Hayakawa | 292/216 |
| 4,913,477 | 4/1990 | Watanuki | 292/216 |
| 4,934,748 | 6/1990 | Hayakawa | 292/336.3 |
| 4,948,183 | 8/1990 | Yamada | 292/216 |
| 5,005,392 | 4/1991 | Shibata | 70/264 |
| 5,015,020 | 5/1991 | Mizuki | 292/336.3 |
| 5,035,453 | 7/1991 | Fukumoto | 292/336.3 |
| 5,350,206 | 9/1994 | Akahori | 292/337 |
| 5,582,444 | 12/1996 | Hayakawa et al. | 292/216 |

FOREIGN PATENT DOCUMENTS 2-30868 2/1990 Japan .

*Primary Examiner*—Steven N. Meyers
*Assistant Examiner*—Gary Estremsky
*Attorney, Agent, or Firm*—Burns, Doane, Swecker & Mathis, LLP

[57] ABSTRACT

A door lock assembly for an automotive vehicle includes a base secured inside a vehicle door, a latch mechanism provided on the base and free to engage with and disengage from the body side of the vehicle, an opening lever provided on the base for operating the latch mechanism via a linking member, a locking lever provided on the base for manipulating the linking member to engage and disengage a transmission path from the opening lever to the latch mechanism, and a protective cover for covering the locking lever and the linking member. The protective cover has an opening and the opening lever has a connecting portion extending outwardly of the protective cover from the opening in offset relation to the opening, wherein the connecting portion is linked to an operating member.

7 Claims, 6 Drawing Sheets

DOOR LOCK ASSEMBLY FOR AUTOMOTIVE VEHICLES

This application is a continuation of application Ser. No. 08/313,576, filed Sep. 27, 1994 now abandoned.

BACKGROUND OF THE INVENTION

1. Field of the Invention

This invention relates to a door lock assembly for automotive vehicles.

2. Description of the Prior Art

An example of a door lock assembly of this kind is disclosed in the specification of Japanese Patent Application Laid-Open (KOKAI) No. 2-30868 (Feb. 1, 1990). The disclosed door lock assembly includes a base secured inside a door hinged on the vehicle body in freely swinging fashion, a latch mechanism provided on the base which includes a latch and a pawl and is free to engage with and disengage from a striker provided on the vehicle body, a lifting lever provided on the base for operating the latch mechanism to disengage the striker and the latch mechanism, an opening lever provided on and connected to each of door handles the base for manipulating the lifting lever via an opening lifting lever, a locking lever provided on the base for manipulating the opening lifting lever to engage and disengage a transmission path from the opening lever to the lifting lever, and a key lever coupled with the locking lever. Various operating members provided on the vehicle door such as key lever and locking lever are connected to the opening lift lever, via respective rods.

In order to prevent the locking lever or opening lifting lever in a door lock assembly from being manipulated unlawfully, usually the lifting lever, opening lever, locking lever, opening lifting lever and key lever are covered by a protective cover secured to the base. In the door lock assembly described above, however, the fact that the operating members are connected to the opening lever, key lever and locking lever requires that the protective cover be formed to have openings large enough to enable the connection to the operating members. As a consequence, an implement such as a piece of wire for tampering with the locking lever or opening lifting lever can easily be inserted from the opening at the connection between the key lever and its operating member and the opening at the connection between the opening lifting lever and its operating member along the path of connection between these operating members and the key lever and opening lifting lever, which are disposed on the exterior side of the passenger compartment. As a result, the vehicle is prone to theft.

SUMMARY OF THE INVENTION

Accordingly, an object of the present invention is to provide a door lock assembly which is more effective at preventing theft.

According to the present invention, the foregoing object is attained by providing a door lock assembly for an automotive vehicle, comprising a base secured inside a vehicle door supported on a vehicle body in freely swinging fashion, a latch mechanism provided on the base and free to engage with and disengage from a striker provided on the body side of the vehicle, an opening lever provided on the base for operating the latch mechanism via a linking means, a locking lever provided on the base for manipulating the linking means to engage and disengage a transmission path from the opening lever to the latch mechanism, and a protective cover for covering the locking lever and the linking means, the protective cover having an opening and the opening lever being formed to have a connecting portion extending outwardly of the protective cover from the opening at a position away from or in offset relation to the opening, wherein the connecting portion is linked to an operating member.

In another aspect of the invention, the protective cover has an opening, a sub-locking lever is provided outboard of the protective cover and is linked to the locking lever via the opening, and the sub-locking lever is formed to have a connecting portion at a position away from or in offset relation to the opening, the connecting portion being linked to an operating member.

In operation, the connecting portion linking the operating member with the opening lever or sub-locking lever is offset with respect to the opening formed in the protective cover. As a result, an implement such as a wire along the path linking the operating member and the opening lever or sub-locking lever cannot penetrate from the opening and reach the locking lever or linking means. This provides greater security against theft in comparison with the prior art.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

A preferred embodiment of a door lock assembly according to the present invention will now be described in detail with reference to the accompanying drawings.

A door lock assembly 1 embodying the present invention includes a housing 2 comprising a housing body, a latch mechanism 3 accommodated within the housing 2 and placed on the door side of the vehicle, and a link mechanism 6 disposed on the housing 2.

Figure 3:
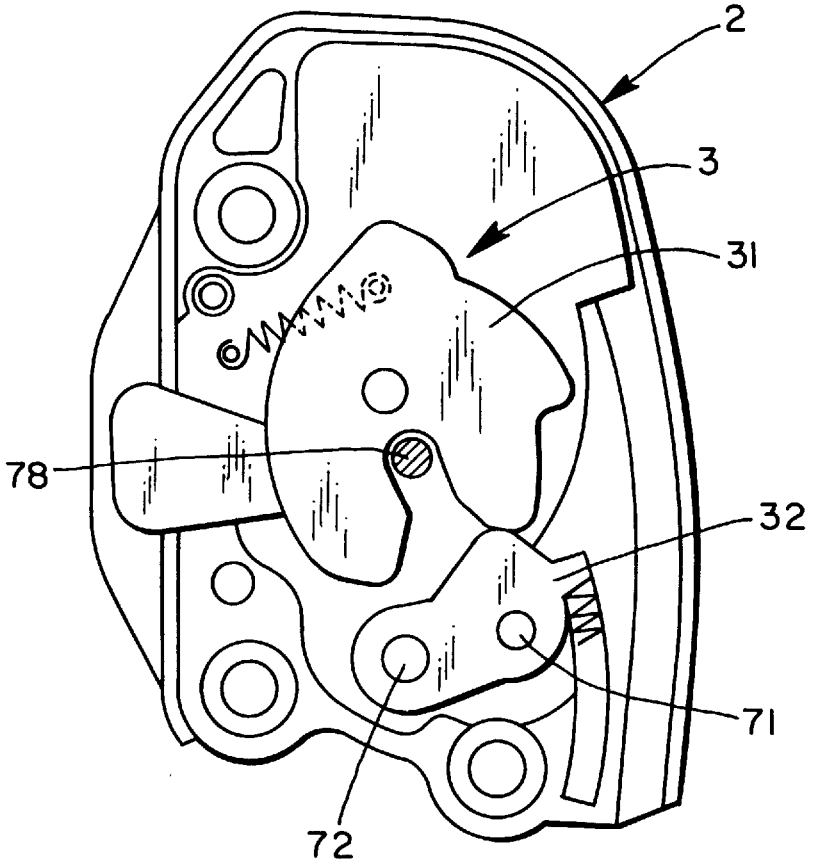
FIG. 3 is a plan view showing a latch mechanism which part of the door lock assembly.

As shown in FIG. 3, the latch mechanism 3 comprises a latch 31 and a pawl 32. The latch 31 and pawl 32 are supported on the housing body of housing 2 so as to be free to turn. The latch 31 is free to be engaged with and disengaged from a striker 78, which is provided on the body side of the vehicle, by opening and closing the vehicle door on which the door lock assembly 1 is mounted. The latch 31 turns by being dragged by the striker 78 in conformity with opening and closing of the vehicle door. The pawl 32, which freely engages with and disengages from the latch 31 due to its own turning motion, turns in conformity with the operation of the link mechanism 6 via a pin 71 and the turning motion of the latch 31. When the latch 31 and pawl 32 are in the engaged state, this is the latched state of the door lock assembly 1, namely the state in which the vehicle door is held closed. When the latch 31 and pawl 32 are in the disengaged state, this is the unlatched state of the door lock assembly 1, namely the state in which the vehicle door is capable of being opened and closed.

The supporting structure of the latch 31 and pawl 32 and the operations thereof are well known in the art.

Figure 1:
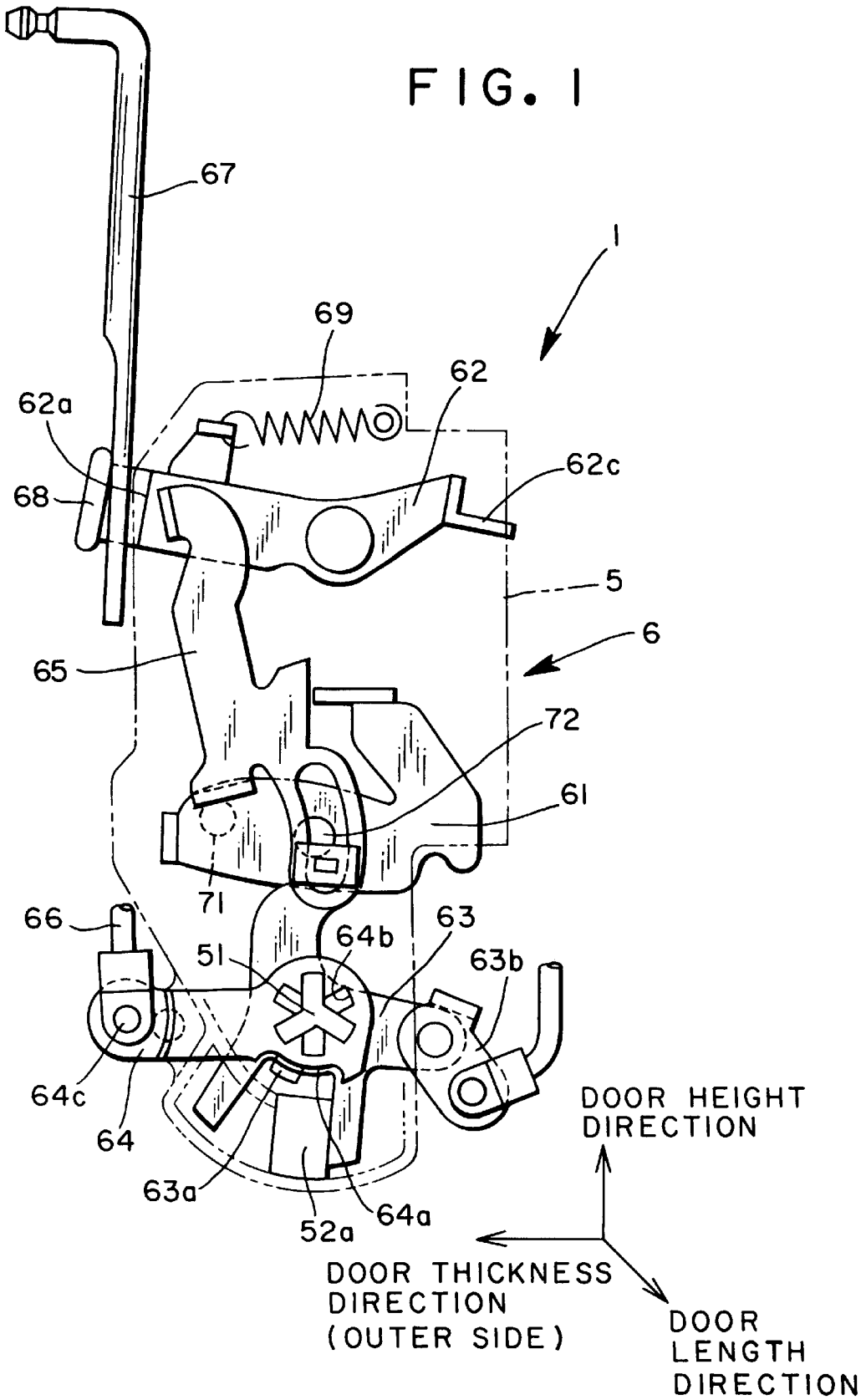
FIG. 1 is a plan view of a vehicular door lock assembly according to the present invention.
Figure 2:
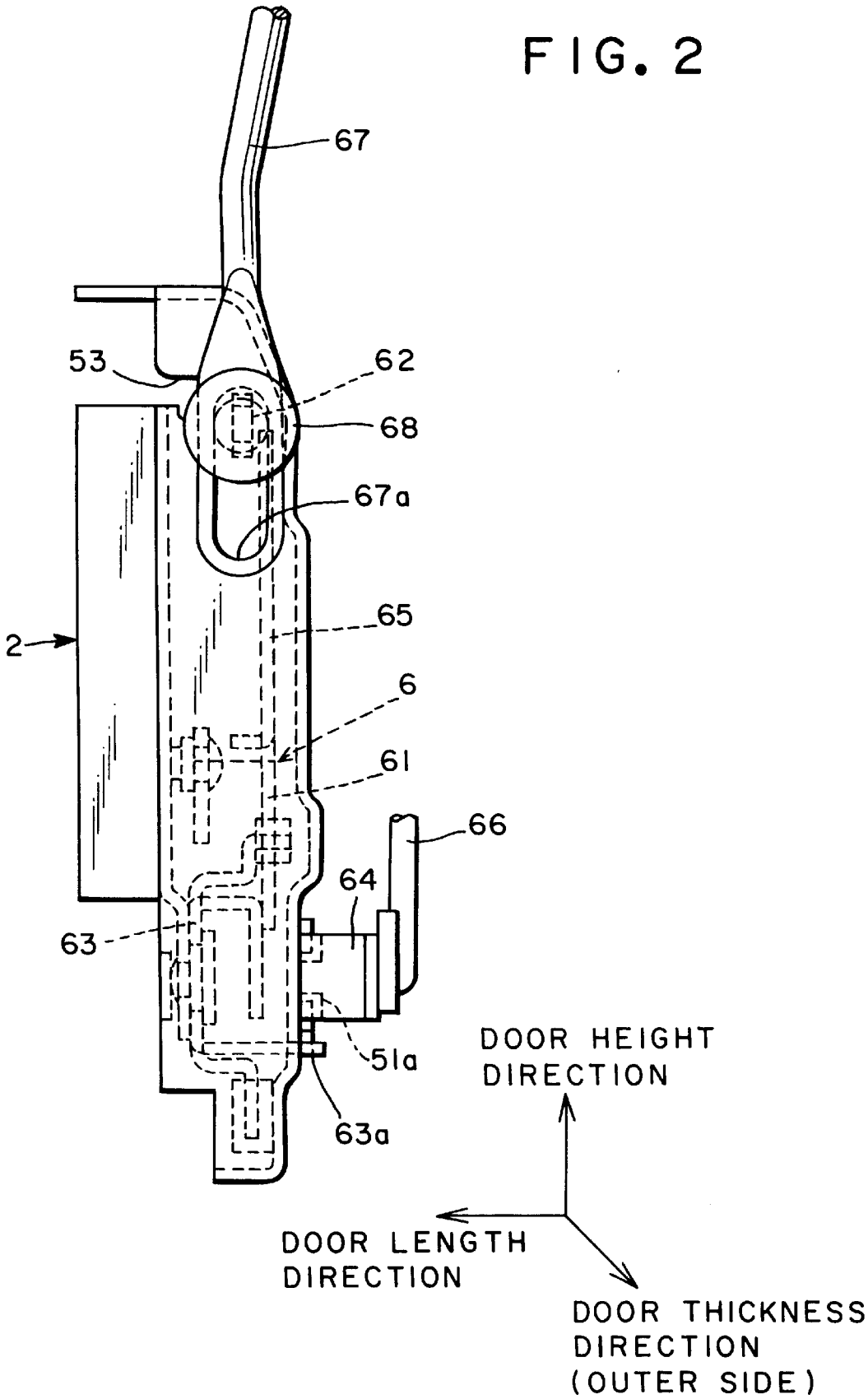
FIG. 2 is a side view of the door lock assembly.

As shown in FIGS. 1 and 2, the link mechanism 6 comprises a lifting lever 61, an opening lever 62, a knob locking lever (locking lever) 63, a key locking lever (sub-locking lever) 64 and an opening lifting lever 65. The opening lifting lever 65 serves as a linking device. The lifting lever 61 and the opening lever 62 are each supported on the housing body of housing 2 so as to be free to turn. The lifting lever 61 is linked to the pawl 32 which is connected through the pin 71 to the lever 61 and rotatable about a pin 72 so that turning the lever 61 will cause the pawl 32 of the latch mechanism 3 to turn. The opening lifting lever 65 is supported on the opening lever 62 so as to be free to turn. The opening lifting lever 65 is moved and actuated by turning motion of the opening lever 62 so as to engage with and disengage from the lifting lever 61. Engagement/disengagement of the opening lifting lever 65 with respect to the lifting lever 61 is enabled or disabled by turning motion with respect to the opening lever 62.

The knob locking lever 63, which is supported on the housing main body of housing 2 so as to be free to turn, is linked to the opening lifting lever 65 so that turning the lever 63 will cause the opening lifting lever 65 to turn with respect to the opening lever 62. The key locking lever 64 is supported so as to be free to turn and is coaxial with the knob locking lever 63. The key locking lever 64 is linked to the knob locking lever 63 so that turning the lever 64 will cause the opening lifting lever 65 to turn with respect to the opening lever 62. This linkage between the knob locking lever 63 and key locking lever 64 is achieved by fitting a flange 63*a* provided on the knob locking lever 63 into a notch 64*a* formed in the key locking lever 64. The structure is such that the knob locking lever 63 is turned by turning the key locking lever 64 whereas the key locking lever 64 cannot be turned by turning the knob locking lever 63. The state in which the lifting lever 61 and opening lifting lever 65 are capable of being engaged and disengaged is the unlocked state of the door lock assembly 1, namely the state in which the latch mechanism 3 is rendered operable (the state in which the latch mechanism 3 is capable of being placed in the unlatched state from the latched state by turning motion of the opening lever 62). The state in which the lifting lever 61 and opening lifting lever 65 are incapable of being engaged and disengaged is the locked state of the door lock assembly 1, namely the state in which the latch mechanism 3 is rendered operable (the state in which the latch mechanism 3 is incapable of being placed in the unlatched state from the latched state by turning motion of the opening lever 62).

As shown in FIGS. 1 and 2, a protective cover 5 is secured to the housing 2. The protective cover 5 is placed between the knob locking lever 63 and key locking lever 64 and covers the lifting lever 61, the opening lever 62, the knob locking lever 63 and the opening lifting lever 65.

The key locking lever 64 is placed outside the protective cover 5 and is supported, so as to be free to turn, on a shaft 51 formed on the protective cover 5. More specifically, with regard to the manner in which the key locking lever 64 is supported on the shaft 51, the shaft 51 is passed through the key locking lever 64 in such a manner that a key-shaped hole 64*b* formed in the key locking lever 64 and key-shaped portions 51*a* formed on the shaft 51 match. By then turning the key locking lever 64, the plane wall near the hole 64*b* and the portion 51*a* engaged each other to prevent the lever 64 from falling off the shaft 51. After the key locking lever 64 is thus supported on the shaft 51, the range over which the key locking lever 64 may turn with respect to the knob locking lever 63 is limited by the engagement between the notch 64*a* and the flange 63*a*, thereby preventing the hole 64*b* and the portion 51 from coming into matching registration.

Figure 6:
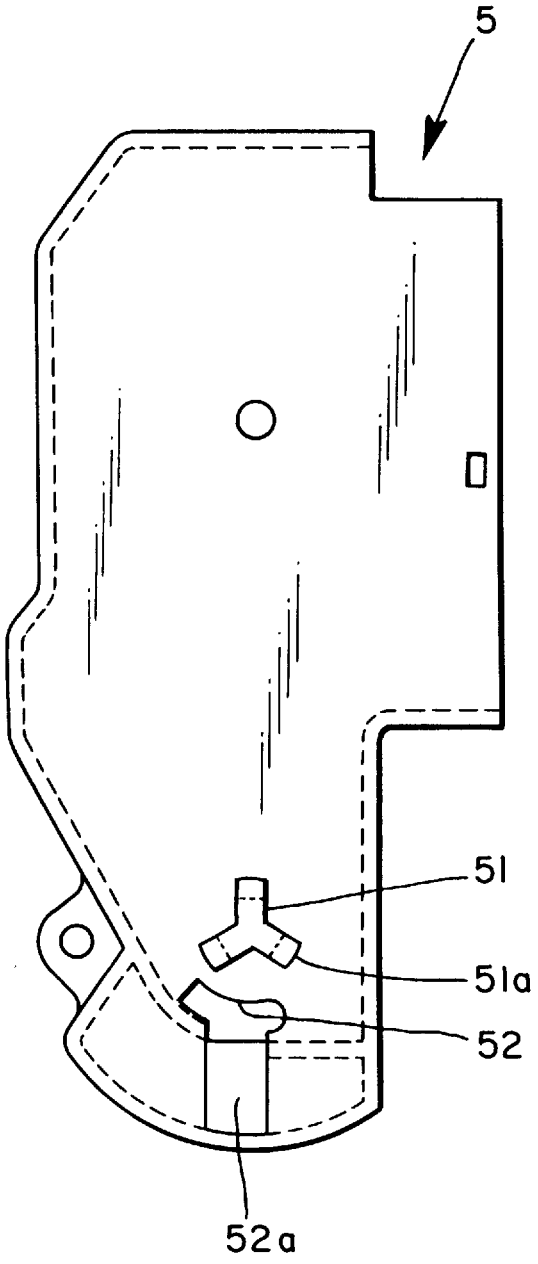
FIG. 6 is a plane view of a cover.
Figure 7:
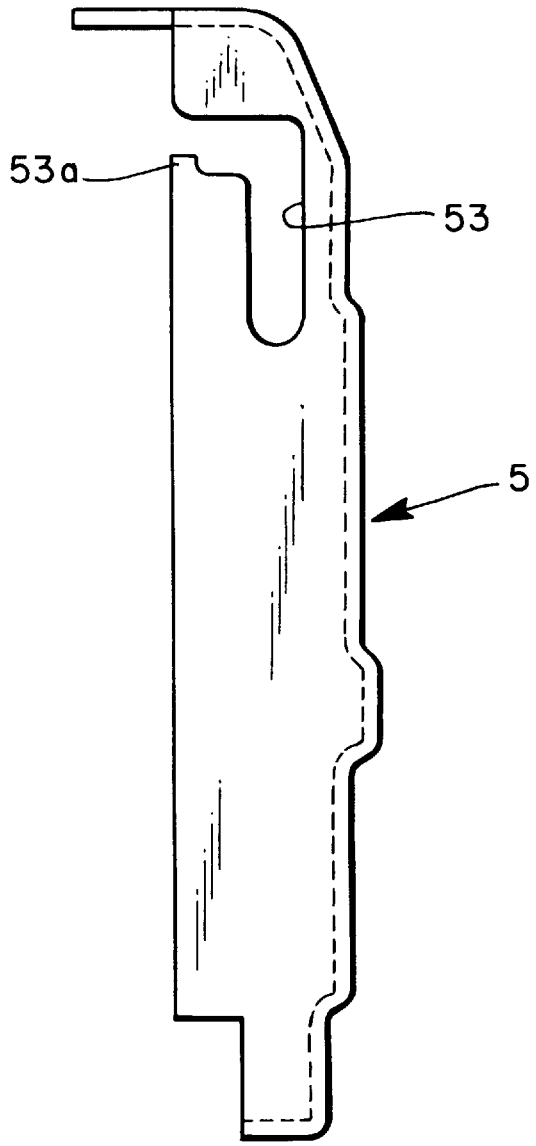
FIG. 7 is a side view of the cover.

Further, the protective cover 5 (refer to FIGS. 6 and 7) is formed to have an opening 52 along an arc whose center is the shaft 51. A stopper 52*a* is inserted in the opening 52 so as to close a part of the opening 52. The flange 63*a* of the knob locking lever 63 and the notch 64*a* of the key locking lever 64 are fitted together through the opening 52. The opening 52, which opened toward the length direction of the door (the longitudinal direction of the vehicle) when the door lock assembly 1 has been mounted in the door, is small and sized so as to be just large enough to allow movement of the flange 63*a* attendant upon turning of the knob locking lever 63. The key locking lever 64 thus supported is formed to have a connecting portion 64*c* offset or away from the opening 52 of the protective cover 5 in the thickness direction of the door when the door lock assembly 1 has been mounted in the door. A key cylinder (not shown) provided in the vehicle door is connected to the connecting portion 64*c* via a rod 66 and parts such as a lever.

Figure 4:
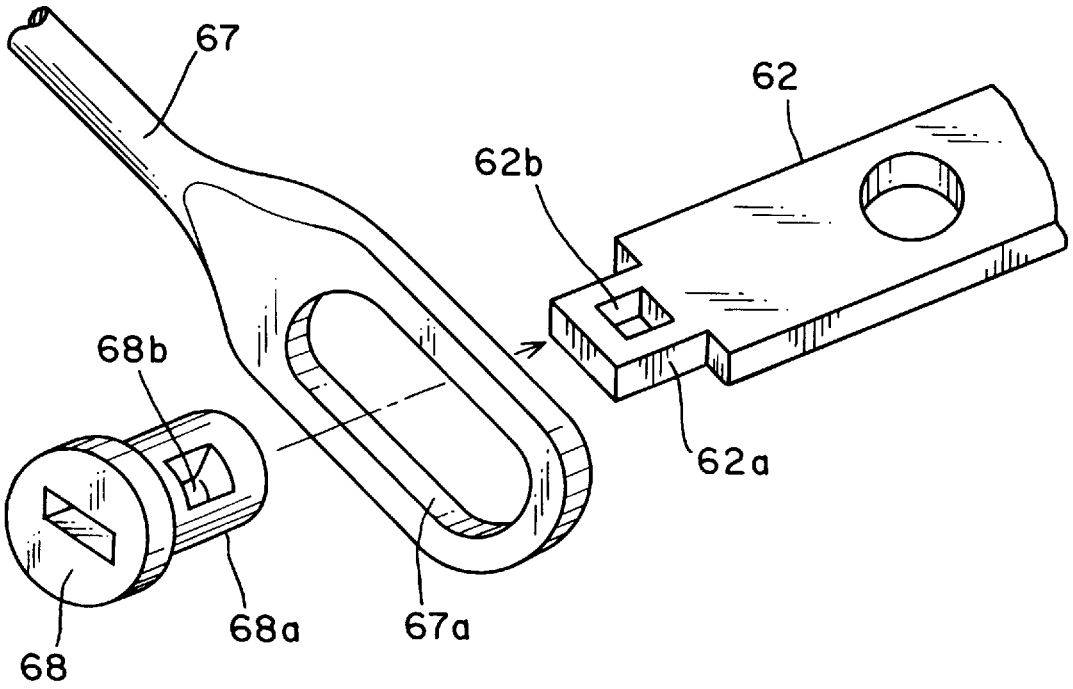
FIG. 4 is a perspective view showing the linking structure of an opening lever and operating member.
Figure 5:
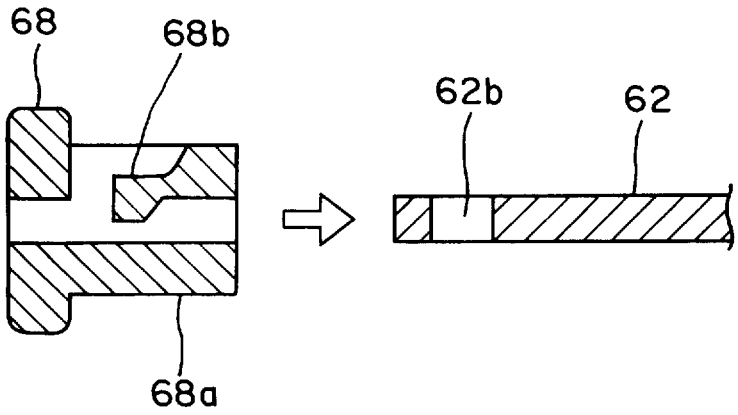
FIG. 5 is a sectional view showing the linking structure of the opening lever and operating member.

The opening lever 62 is formed to have a connecting portion 62*a* extending outwardly of the protective cover 5 via an opening 53 (refer to FIG. 7) formed in the protective cover 5. The entrance of the opening 53 is narrow by an extension 53*a*. The connecting portion 62*a* is offset or away from the opening 53 in the direction of door thickness. An outside handle (not shown) provided on the vehicle door is connected to the connecting portion 62*a* by a clip 68 via a rod 67 and parts such as a lever. The opening 53, which opens toward the direction of door thickness when the door lock assembly 1 has been mounted in the door, is small and sized so as to be just large enough to allow movement of the connecting portion 62*a* attendant upon turning motion of the opening lever 62. As shown in FIGS. 4 and 5, the connection between the connecting portion 62*a* of the opening lever 62 and the rod 67 by means of the clip 68 is achieved by passing a shaft portion 68*a* formed on the clip 68 through an oblong hole 67*a* formed in the rod 67 and mating a hole 62*b* formed in the connecting portion 62*a* and a projection 68*b* formed on the clip 68. As a result, the connection between the rod 67 and the opening lever 62 is simplified.

The other ends of the knob locking lever 63 and opening lever 62 are formed to have connecting portions 63*b*, 62*c*, respectively. A locking knob (not shown) and an inside handle (not shown) provided on the vehicle door are connected to the knob locking lever 63 and opening lever 62 via the connecting portions 63*b*, 62*c* by means of rods, levers and the like.

Thus, the connecting portion 64*c* of the key locking lever 64 and the connecting portion 62*a* of the opening lever 62, which are situated outboard of the door when the door locking assembly 1 has been installed in the vehicle door, are offset with respect to or away from the openings 52, 53 of the protective cover 5. As a result, even if an implement such as a wire is inserted into the vehicle door equipped with the door lock assembly 1 along the connecting path connecting the key locking lever 64 and the key cylinder or the connecting path connecting the opening lever 62 and the outside handle, it is difficult for the implement to penetrate and reach the knob locking lever 63 or opening lifting handle 65, which are covered by the protective cover 5, from the openings 52, 53 in the protective cover. This provides greater safety against theft in comparison with the prior art door lock. Further, since the opening 52 is a small aperture opening the length direction of the door and the opening 53 is a small aperture opening in the direction of door thickness, an implement such as wire which may be inserted from the door height direction cannot readily penetrate the openings 52, 53. This also provides greater security in terms of preventing theft. Though the connecting portions 62*c*, 63*b* of the opening lever 62 and knob locking lever 63 extend outwardly of the protective cover 5 from openings in the protective cover 5 and are linked to the inside handle and locking knob, these connecting portions 62*c*, 63*b* are situated on the inner side of the door. This means that an implement such as wire will not be able to penetrate the interior of the door having the door lock assembly 1 along the paths linking the opening lever 62 and knob locking lever 63 with the inside handle and locking knob. It should be noted that since the key locking lever 64 is held by the key cylinder, it will not be moved by an implement such as wire even though it is placed outside the protective cover 5.

The operation of the door lock assembly will now be described.

The solid lines in FIGS. 1 through 3 illustrate the door lock assembly 1 when it is in the latched and locked state (in which state the vehicle door is closed). When the locking knob or key cylinder is manipulated to turn the knob locking lever 63 counter-clockwise (in FIG. 1) in this state, the opening lifting lever 65 turns clockwise (in FIG. 1) on the opening lever 62. As a result, the opening lifting lever 65 is placed on a path along which the lifting lever 61 and opening lifting lever 65 are capable of being engaged and disengaged. The door lock assembly 1 is placed in the unlocked state.

When the inside handle or outside handle is manipulated to turn the opening lever 62 counter-clockwise in FIG. 1 at such time that the door lock assembly 1 is in the unlocked and latched state, the opening lifting lever 65 and lifting lever 61 engage. As a result, the pawl 32 turns and is disengaged from the latch 31 so that the door lock assembly 1 is placed in the unlatched state (the state in which the vehicle door is capable of being opened and closed). The operation for placing the door lock assembly 1 in the latched state from the unlatched state is performed automatically by placing the vehicle door in the closed state from the open state.

A spring 69 is stretched between the opening lever 62 and a plate secured to the housing 2. The opening lever 62 and opening lifting lever 65 are thus biased at initial positions at all times by the biasing force of the spring 69.

Though the lifting lever 61 and opening lifting lever 65 are in a state in which they can be engaged or in a state in which they cannot be engaged according to this embodiment, it is permissible to adopt an arrangement in which the pawl 32 and opening lifting lever 65 are directly placed in a state in which they can or cannot be engaged.

Thus, in accordance with the present invention, a connecting portion for linking an operating member with an opening lever or sublever is offset with respect to an opening formed in a protective cover. As a result, an implement such as a wire along the path linking the operating member and the opening lever or sublever cannot penetrate from the opening and reach a locking lever or linking member. This provides greater security against theft in comparison with the prior art.

As many apparently widely different embodiments of the present invention can be made without daparting from the spirit and scope thereof, it is to be understood that the invention is not limited to the specific embodiments thereof except as defined in the appended claims.

What is claimed is:

1. A door lock assembly for an automotive vehicle, comprising:

a base adapted to be secured inside a vehicle door supported on a vehicle body in freely swinging fashion;

a latch mechanism provided on said base and adapted to engage with and disengage from a striker on a body side of the vehicle;

an opening lever provided on said base for operating said latch mechanism via a linking device;

a rod operably connected to said opening lever;

a locking lever provided on said base for manipulating said linking device to engage and disengage a transmission path from said opening lever to said latch mechanism;

a protective cover for covering said locking lever and said linking device, said protective cover having a first opening, said protective cover having a second opening through which a part of said opening lever is projected outwardly from a side wall of the protective cover, the second opening including an entrance that is narrowed by an extension of the protective cover, said rod extending perpendicularly with respect to an opening direction of said second opening, said second opening opening in a direction substantially perpendicular to the direction in which said first opening opens;

a sub-locking lever having a mounting portion by which the sub-locking lever is mounted for rotational movement on said protective cover, said mounting portion of the sub-locking lever being provided outboard of said protective cover, said sub-locking lever being linked to said locking lever via said first opening; and said sub-locking lever having a connecting portion connected to an operating member, said connecting portion extending in a direction which is substantially at a right angle to an opening direction of said first opening, said first opening being adapted to be located inward of the operating member with respect to a door thickness direction of the vehicle door.

2. A door lock assembly according to claim 1, wherein said first opening is adapted to open in a direction of a door length of the vehicle door.

3. A door lock assembly for an automotive vehicle, comprising:

a base adapted to be secured inside a vehicle door supported on a vehicle body in a freely swinging fashion;

a latch mechanism provided on said base and adapted to engage with and disengage from a striker on a body side of the vehicle;

an opening lever provided on said base for operating said latch mechanism via a linking device;

a locking lever provided on said base for manipulating said linking device to engage and disengage a transmission path from said opening lever to said latch mechanism;

a protective cover for covering said locking lever and said linking device, said protective cover having a wall and an opening formed in said wall;

a sub-locking lever having a mounting portion by which the sub-locking lever is mounted for rotational movement on said protective cover, said mounting portion of the sub-locking lever being provided outboard of said protective cover; and said sub-locking lever having a connecting portion connected to an operating member that is adapted to be operatively connected to a locking device, said connecting portion extending in a direction which is substantially at a right angle to an opening direction of said opening, said opening being adapted to be located inward of the operating member with respect to a door thickness direction of the vehicle door, said opening being open in a direction that is adapted to be in the direction of a door length of the vehicle door, said sub-locking lever being linked to said locking lever by way of a flange extending outwardly through said opening in said wall of the protective cover.

4. A door lock assembly according to claim 3, wherein said flange is formed on the locking lever, said flange extending from inside the protective cover to an exterior of the cover and being positioned within a notch formed on the sub-locking lever so as to allow a predetermined amount of a rotation of said sub-locking lever.

5. A door lock assembly according to claim 4, wherein said opening includes an entrance that is narrowed by a stopper position in the opening.

6. A door lock assembly according to claim 5, wherein said protective cover includes a shaft extending from said wall of said protective cover, said sub-locking lever being mounted on said shaft.

7. A door lock assembly according to claim 3, wherein the locking lever includes a connecting portion for connecting the locking lever to a locking knob.

* * * * *